United States Patent [19]

Vanmaele et al.

[11] Patent Number: 4,987,119

[45] Date of Patent: Jan. 22, 1991

[54] CYAN DYES IN DYE-DONOR ELEMENTS FOR USE IN THERMAL DYE TRANSFER METHODS

[75] Inventors: Luc J. Vanmaele, Lochristi; Wilhelmus Janssens, Aarschot, both of Belgium

[73] Assignee: AGFA-Gevaert, N.V., Mortsel, Belgium

[21] Appl. No.: 485,564

[22] Filed: Feb. 27, 1990

[30] Foreign Application Priority Data

Feb. 28, 1989 [EP] European Pat. Off. ..... 89200490

[51] Int. Cl.[5] ..... B41M 5/035; B41M 5/26

[52] U.S. Cl. ..... 503/227; 8/471; 428/195; 428/480; 428/913; 428/914

[58] Field of Search ..... 8/471; 428/195, 480, 428/913, 914

[56] References Cited

U.S. PATENT DOCUMENTS 4,695,287 9/1987 Evans et al. ..... 8/471

FOREIGN PATENT DOCUMENTS 0227096 7/1987 European Pat. Off. ..... 503/227
0270677 6/1988 European Pat. Off. ..... 503/227
0279330 8/1988 European Pat. Off. ..... 503/227
0285665 10/1988 European Pat. Off. ..... 503/227

*Primary Examiner*—Bruce H. Hess
*Attorney, Agent, or Firm*—A. W. Breiner

[57] ABSTRACT

Dye-donor element for use according to thermal dye transfer methods, said element comprising a support having thereon a dye/binder layer comprising a 2-N-alkyl-substituted carbamoyl-4-[N-(p-substituted aminoaryl)-imino]-1,4-naphthoquinone cyan dye carried by a polymeric binder resin, said dye being a 2-N-alkyl-substituted carbamoyl-4-[N-(p-substituted aminoaryl)-imino]-1,4-naphthoquinone cyan dye, the N-alkyl group of which is methyl that is substituted with a branched-chain non-cyclic $C_3$–$C_{18}$ alkyl group or the N-alkyl group of which is a $C_2$–$C_4$ straight chain alkyl group that on its omega-carbon atom is substituted with a branched chain $C_3$–$C_{18}$ alkyl group, an aryl group, or a cycloalkyl group.

6 Claims, No Drawings

CYAN DYES IN DYE-DONOR ELEMENTS FOR USE IN THERMAL DYE TRANSFER METHODS

BACKGROUND OF THE INVENTION

1. Field of the Invention:

The present invention relates to dye-donor elements for use according to thermal dye transfer methods, in particular to dye-donor elements comprising cyan dyes that have a good solubility in ecologically acceptable solvents and at the same time give high transfer densities and a good hue.

2. Description of the Prior art:

Thermal transfer methods have been developed to make prints from electronic pattern information signals e.g. from pictures that have been generated electronically by means of a colour video camera. To make such prints the electronic picture can be subjected to colour separation with the aid of colour filters. The different colour selections thus obtained can then be converted into electric signals, which can be processed to form cyan, magenta, and yellow electrical signals. The resulting electrical colour signals can then be transmitted to a thermal printer. To make the print a dye-donor element having repeated separate blocks of cyan, magenta, and yellow dye is placed in face-to-face contact with a receiving sheet and the resulting sandwich is inserted between a thermal printing head and a platen roller. The thermal printing head, which is provided with a plurality of juxtaposed heat-generating resistors, can selectively supply heat to the back of the dye-donor element. For that purpose it is heated up sequentially in correspondence with the cyan, magenta, and yellow electrical signals, so that dye from the selectively heated regions of the dye-donor element is transferred to the receiver sheet and forms a pattern thereon, the shape and density of which are in accordance with the pattern and intensity of the heat supplied to the dye-donor element.

The dye-donor element usually comprises a very thin support e.g. a polyester support, which is coated on both sides with an adhesive or subbing layer, one adhesive or subbing layer being covered with a slipping layer that provides a lubricated surface against which the thermal printing head can pass without suffering abrasion, the other adhesive layer at the opposite side of the support being covered with a dye/binder layer, which contains the printing dyes in a form that can be released in varying amounts depending on, as mentioned above, how much heat is applied to the dye-donor element.

The dye/binder layer comprising said repeated separate blocks of cyan, magenta, and yellow dye can be coated from a solution in appropriate solvents on the subbed support, but the known coating techniques are not quite adapted to the discontinuous repeated coating of three differently coloured dye/binder areas on said very thin support. It is therefore customary, especially in large-scale manufacturing conditions, to print said dye/binder layer on said support by printing techniques such as a gravure process.

In order to make possible an easy printing of the dye/binder composition on the support, this composition should comprise a good solvent to give it a printable ink-like nature.

The 2-carbamoyl-4-[N-(p-substituted aminoaryl)-imino]-1,4-naphthoquinone cyan dyes described in EP-A No. 227,096 have a favourable stability to light and a good hue, but they have the important drawback of having a solubility in common solvents like acetone, ethyl methyl ketone, and ethyl acetate that is too poor for being usable in the large-scale production of dye-donor elements according to the customary gravure printing techniques. The dyes should have a better solubility i.e. a solubility of at least 6% by weight, which means that one or more chlorinated hydrocarbon solvents such as methylene chloride, ethylene dichloride, and 1,1,2-trichloroethane have to be used as solvent or solvent mixture to render these cyan dyes printable.

However, from an ecological standpoint these chlorinated hydrocarbon solvents are being rejected nowadays and their recovery from a hot airstream used for drying the printed dye-donor element requires difficult and expensive techniques.

The similar 2-carbamoyl-4-[N-(p-substituted aminoaryl)-imino]-1,4-naphthoquinone dyes described in EP-A No. 270,677, EP-A No. 279,330, EP-A 285,665, JP-A 61-268,493, and JP-A 60-239,289 also have a poor solubility in common solvents and can thus hardly be printed according to customary gravure printing techniques.

SUMMARY OF THE INVENTION

It is therefore an object of the present invention to provide a dye-donor element comprising in the dye/-binder layer a cyan dye that in addition to having a favourable stability to light and a good hue also has a satisfactory solubility in ecologically harmless solvents.

This and other objects are achieved by providing a dye-donor element for use according to thermal dye transfer methods, said element comprising a support having thereon a dye/binder layer comprising a 2-N-alkyl-substituted carbamoyl-4-[N-(p-substituted aminoaryl)-imino]-1,4-naphthoquinone cyan dye carried by a polymeric binder resin, characterized in that said cyan dye is a 2-N-alkyl-substituted carbamoyl-4-[N-(p-substituted aminoaryl)-imino]-1,4-naphthoquinone cyan dye, the N-alkyl group of which is methyl that is substituted with a branched-chain non-cyclic $C_3$–$C_{18}$ alkyl group or the N-alkyl group of which is a $C_2$–$C_4$ straight chain alkyl group that on its omega-carbon atom is substituted with a branched chain $C_3$–$C_{18}$ alkyl group, an aryl group, or a cycloalkyl group.

DETAILED DESCRIPTION OF THE INVENTION

The dye-donor element according to the present invention comprises a support, which is preferably coated on both sides with an adhesive layer, one adhesive layer being covered with a slipping layer to prevent the thermal printing head from sticking to the dye-donor element, the other adhesive layer at the opposite side of the support being covered with a dye/binder layer, which contains the printing dyes in differently coloured dye/binder areas in a form that can be released in varying amounts depending on, as mentioned above, how much heat is applied to the dye-donor element, said differently coloured dye/binder areas including cyan dye/binder areas, the cyan dyes of which are of the 2-N-alkyl-substituted carbamoyl-4-[N-(p-substituted aminoaryl)-imino]-1,4-naphthoquinone class, wherein the N-alkyl group is methyl that is substituted with a branched-chain non-cyclic $C_3$–$C_{18}$ alkyl group or the N-alkyl group is a $C_2$–$C_4$ straight chain alkyl group that on its omega-carbon atom is substituted with a branched chain $C_3$–$C_{18}$ alkyl group, an aryl group, or a cycloalkyl group.

According to a preferred embodiment of the invention the cyan dyes have the following formula:

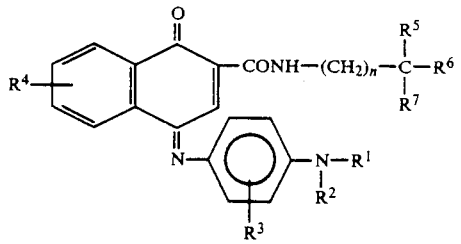

wherein:

each of $R^1$ and $R^2$ represents a $C_1$–$C_8$ alkyl group, a substituted $C_1$–$C_8$ alkyl group, a cycloalkyl group, a substituted cycloalkyl group, an aryl group, or a substituted aryl group, or $R^1$ and $R^2$ together represent the atoms necessary for completing a heterocyclic nucleus or substituted heterocyclic nucleus, or $R^1$ and/or $R^2$ together with $R^3$ represent the atoms necessary for completing a fused-on heterocyclic nucleus or substituted fused-on heterocyclic nucleus, $R^1$ and $R^2$ being same or different, $R^3$ is a substituent in ortho- or meta-position and is chosen from the group consisting of hydrogen, a halogen atom, a $C_1$–$C_8$ alkyl group, a substituted $C_1$–$C_8$ alkyl group, a $C_1$–$C_8$ alkoxy group, a substituted $C_1$–$C_8$ alkoxy group, nitro, cyano, a —NHCO—R′ group, a —$NHSO_2$—R′ group, a —CONH—R′ group, and a —$SO_2NH$—R′ group, in which R′ stands for an alkyl group, a substituted alkyl group, a cycloalkyl group, a substituted cycloalkyl group, an aryl group, or a substituted aryl group, or $R^3$ together with $R^1$ and/or $R^2$ represents the atoms necessary for completing a fused-on heterocyclic nucleus or substituted fused-on heterocyclic nucleus, $R^4$ is a substituent standing in 5-, 6-, 7-, or 8-position and having one of the significances given to $R^3$, $R^3$ and $R^4$ being same or different, and n represents a positive integer from 1 to 4, with the proviso that when n=1, $R^5$ stands for hydrogen or a straight-chain or branched-chain non-cyclic $C_1$–$C_7$ alkyl group, and each of $R^6$ and $R^7$ stand for a straight-chain or branched-chain non-cyclic $C_1$–$C_7$ alkyl group, $R^5$, $R^6$, and $R^7$ being same or different, and when n=2, 3, or 4, $R^5$ stands for a substituent selected from the group consisting of hydrogen, a straight-chain or branched-chain $C_1$–$C_7$ alkyl group, a cycloalkyl group, and an aryl group, and each of $R^6$ and $R^7$ stand for a substituent selected from the group consisting of a straight-chain or branched-chain $C_1$–$C_7$ alkyl group, a cycloalkyl group, and an aryl group, or $R^6$ and $R^7$ together represent the atoms necessary to complete an aromatic nucleus or an alicyclic nucleus, $R^5$, $R^6$, and $R^7$ being same or different.

Suitable examples of substituents represented by $R^1$ and $R^2$ are i.a. methyl, ethyl, propyl, isopropyl, butyl, pentyl, hexyl, benzyl, methoxycarbonylmethyl, 2-methoxyethyl, 2-hydroxyethyl, 2-cyanoethyl, 4-sulphobutyl, 2-(methylsulphonylamino)-ethyl, cyclohexyl, cyclopentyl, cycloheptyl, phenyl, pyridyl, naphthyl, p-tolyl, p-chlorophenyl, and m-(N-methylsulphamoyl)-phenyl.

Suitable examples of substituents represented by $R^3$ and $R^4$ are i.a. methyl, ethyl, propyl, isopropyl, butyl, pentyl, hexyl, benzyl, methoxy, ethoxy, 2-methoxyethyl, 2-hydroxyethyl, 2-cyanoethyl, 2-(methylsulphonylamino)-ethyl, acetamido, dimethylsulfamoyl, dimethylcarbamoyl, chloro, bromo, and fluoro.

Suitable examples of substituents represented by $R^5$, when n=1, are hydrogen, methyl, and ethyl or, when n=2 to 4, are hydrogen, methyl, ethyl, cyclohexyl, cyclopentyl, cycloheptyl, and phenyl.

Suitable examples of substituents represented by $R^6$ and $R^7$, when n=1, are methyl and ethyl or, when n=2 to 4, are methyl, ethyl, isopropyl, tert-pentyl, cyclohexyl, cyclopentyl, cycloheptyl, and phenyl.

Representative examples of 2-N-alkyl-substituted carbamoyl-4-[N-(p-substituted aminoaryl)-imino]-1,4-naphthoquinone cyan dyes that can be used in accordance with the present invention are listed in the following Table 1, the symbols used therein referring to the above formula.

TABLE 1

| Dye | n | $R^5$ | $R^6$ | $R^7$ | $R^1$ | $R^2$ | $R^3$ | $R^4$ |
|---|---|---|---|---|---|---|---|---|
| C1 | 1 | H | $CH_3$ | $CH_3$ | $C_2H_5$ | $C_2H_5$ | H | H |
| C2 | 2 | H | $CH_3$ | $CH_3$ | $C_2H_5$ | $C_2H_5$ | H | H |
| C3 | 1 | H | $CH_3$ | $CH_3$ | $C_2H_5$ | $C_2H_5$ | $CH_3$ | H |
| C4 | 2 | H | $CH_3$ | $CH_3$ | $C_2H_5$ | $C_2H_5$ | $CH_3$ | H |
| C5 | 2 | H | $CH_3$ | tert-pentyl | $C_2H_5$ | $C_2H_5$ | H | H |
| C6 | 1 | $CH_3$ | $CH_3$ | $CH_3$ | $C_2H_5$ | $C_2H_5$ | H | H |
| C7 | 2 | $R^5 + R^6 + R^7$ complete phenyl | | | $C_2H_5$ | $C_2H_5$ | H | H |

The following preparation illustrates the synthesis of cyan dyes according to the present invention. Other dyes that can be used according to the present invention can be prepared in an analogous way.

PREPARATION: Cyan dye Cl (a) 2-(N-isobutyl)-carbamoyl-1-naphthol

An amount of 1000 g (3.8 mol) of 1-naphthol-2-carboxylic acid phenyl ester is dissolved in 3 l of diisopropyl ether. The solution is heated until complete dissolution. A volume of 751 ml (2 equivalents) of isobutylamine is added dropwise. The solution is refluxed for 30 min, allowed to cool and crystallize overnight. The crystals are filtered, rinsed with n-hexane, dried, and used as such in the next step. Yield: 760 g.

(b) 4-[N-(p-diethylaminophenyl)-imino]-2-(N-isobutyl)-carbamoyl-1,4-naphthoquinone An amount of 380 g (1.56 mol) of the product obtained under step (a) is dissolved in 1.9 l of ethyl acetate (first solution). An amount of 830 g of sodium carbonate is dissolved in 2.8 l of demineralized water and 1.9 l of ethyl acetate and 345 g of N,N-diethyl-p-phenylenediamine monohydrochloride (1.1 equivalent) are added (second solution).

The aqueous layer is added immediately to the first solution. A solution of 2.57 kg of potassium cyanoferrate (III) in 6.5 l of demineralized water is made (third solution).

The organic layer of the second solution and the third solution are added separately and dropwise in about 2 h to the first solution with stirring. After the addition stirring is continued for 30 min. The precipitate is filtered with suction, rinsed with water, and dried. Yield: 447.3 g of cyan dye Cl.

Instead of the above reaction step (b) the alternative reaction step (c) described hereinafter can be followed for the synthesis of cyan dye Cl.

(c) 4-[N-(p-diethylaminophenyl)-imino]-2-(N-isobutyl)-carbamoyl-1,4-naphthoquinone An amount of 5.0 g (20.5 mmol) of 2-(N-isobutyl)-carbamoyl-1-naphthol is added to 20 ml of methanol whilst heating. When the mixture reaches 60° C., 3.74 g (1.1 equivalent) of 1-N-diethylamino-4-nitrosobenzene and 5 equivalents of piperidine are added at once.

The reaction mixture is then stirred for 30 min without heating. The reaction mixture obtained is refluxed. As soon as the reaction has come to an end, the reaction product is concentrated by evaporation. The residue is dissolved in methylene chloride and the resulting solution is washed with 1N hydrochloric acid until acidic. The organic layer is rinsed with a saturated aqueous sodium chloride solution until neutral. Finally the solution is dried over sodium sulphate, filtered, and concentrated by evaporation. Purification by column chromatography. Yield: 4.5 g of cyan dye Cl.

The dye/binder layer is formed preferably by adding the dyes, the binder resin, and other optional components to a suitable solvent or solvent mixture, dissolving or dispersing the ingredients to form a composition that is applied to a support, which may have been provided first with an adhesive layer, and dried.

The solvent used to dissolve or disperse the cyan dyes of the present invention is preferably at least one ecologically harmless solvent such as i.a. ethyl methyl ketone, acetone, ethyl acetate, methyl acetate, propyl acetate, isopropyl acetate, butyl acetate, ethyl formiate, methyl propionate, ethyl propionate, diethyl ketone, diethyl carbonate, n-propyl methyl ketone, diisopropyl ether, cyclohexane, ligroin, benzene, xylene, nitromethane, tetrahydrofuran, and toluene. Mixtures of these solvents can be used.

The composition comprising the cyan dyes of the present invention, a binder resin, and at least one of the above-identified ecologically harmless solvents has an ink-like nature and can thus be easily printed on said support by printing techniques such as a gravure process.

The binder resin can be chosen from cellulose derivatives like ethyl cellulose, hydroxyethyl cellulose, ethylhydroxy cellulose, ethylhydroxyethyl cellulose, hydroxypropyl cellulose, methyl cellulose, cellulose acetate, cellulose acetate formate, cellulose acetate propionate, cellulose acetate butyrate, cellulose acetate pentanoate, cellulose acetate hexanoate, cellulose acetate heptanoate, cellulose acetate benzoate, cellulose acetate hydrogen phthalate, cellulose triacetate, and cellulose nitrate; vinyl-type resins like polyvinyl alcohol, polyvinyl acetate, polyvinyl butyral, polyvinyl pyrrolidone, polyvinyl acetoacetal, and polyacrylamide; polymers and copolymers derived from acrylates and acrylate derivatives, such as polyacrylic acid, polymethyl methacrylate, and styrene-acrylate copolymers; polyester resins; polycarbonates; poly(styrene-co-acrylonitrile); polysulfones; polyphenylene oxide; organosilicones such as polysiloxanes; epoxy resins and natural resins, such as gum arabic.

The binder resin can be added to the dye/binder layer in widely varying concentrations. In general, good results are obtained with 0.1 to 5 g of binder resin per m2 of coated support.

In addition to the cyan dyes of the present invention any dye can be used in the dye/binder layer of the dye-donor element of the present invention provided it is transferable to the receiver sheet by the action of heat. Suitable dyes are those described in e.g. EP-A 209,990, EP-A 209,991, EP-A 216,483, EP-A 218,397, EP-A 227,095, EP-A 227,096, EP-A 229,374, EP-A 257,577, EP-A 257,580, JP 84/78894, JP 84/78895, JP 84/78896, JP 84/227,490, JP 84/227,948, JP 85/27594, JP 85/30391, JP 85/229,787, JP 85/229,789, JP 85/229,790, JP 85/229,791, JP 85/229,792, JP 85/229,793, JP 85/229,795, JP 86/41596, JP 86/268,493, JP 86/268,494, JP 86/268,495, and JP 86/284,489.

The dye/binder layer comprises from 0.05 to 1 g of dye per m2.

The dye/binder layer can also comprise other components such as e.g. curing agents, preservatives, and other ingredients, which have been described exhaustively in EP-A 0,133,011, EP-A 0,133,012, and EP-A 0,111,004.

Any material can be used as the support for the dye-donor element provided it is dimensionally stable and capable of withstanding the temperatures involved, i.e. up to 400° C. over a period of up to 20 msec, and is yet thin enough to transmit heat supplied to one side through to the dye on the other side to effect transfer to the receiver sheet within such short periods, typically from 1 to 10 msec. Such materials include polyesters such as polyethylene therephthalate, polyamides, polyacrylates, polycarbonates, cellulose esters, fluorinated polymers, polyethers, polyacetals, polyolefins, polyimides, glassine paper, and condenser paper. Preference is given to a support comprising polyethylene terephthalate. In general, the support has a thickness of 2 to 30 μm. If desired, the support can be coated with an adhesive or subbing layer.

When the dye/binder layer comprises sequential repeating areas of different dyes like e.g. cyan, magenta, and yellow dye, it is preferably applied to the subbed support by printing techniques such as a gravure process. When the dye/binder layer is a monochrome cyan layer, it can also be applied to the support by common coating techniques.

A dye barrier layer comprising a hydrophilic polymer can be provided between the support and the dye/binder layer of the dye-donor element to improve the dye transfer densities by preventing wrong-way transfer of dye into the support. The dye barrier layer may contain any hydrophilic material that is useful for the intended purpose. In general, good results have been obtained with gelatin, polyacrylamide, polyisopropyl acrylamide, butyl methacrylate-grafted gelatin, ethyl methacrylate-grafted gelatin, ethyl acrylate-grafted gelatin, cellulose monoacetate, methylcellulose, polyvinyl alcohol, polyethylene imine, polyacrylic acid, a mixture of polyvinyl alcohol and polyvinyl acetate, a mixture of polyvinyl alcohol and polyacrylic acid, or a mixture of cellulose monoacetate and polyacrylic acid. Suitable dye barrier layers have been described in e.g. EP-A 0,227,091 and EP-A 0,228,065. Certain hydrophilic polymers e.g. those described in EP-A 0,227,091 also have an adequate adhesion to the support and the dye/binder layer, thus eliminating the need for a separate adhesive or subbing layer. These particular hydrophilic polymers used in one single layer in the dye-donor element thus perform a dual function, hence are referred to as dye barrier/subbing layers.

Preferably the reverse side of the dye-donor element can be coated with a slipping layer to prevent the printing head from sticking to the dye-donor element. Such a slipping layer would comprise a lubricating material such as a surface-active agent, a liquid lubricant, a solid lubricant, or mixtures thereof, with or without a polymeric binder. The surface-active agents may be any agents known in the art such as carboxylates, sulfonates, phosphates, aliphatic amine salts, aliphatic quaternary ammonium salts, polyoxyethylene alkyl ethers, polyethylene glycol fatty acid esters, and fluoroalkyl $C_2$–$C_{20}$ aliphatic acids. Examples of liquid lubricants include silicone oils, synthetic oils, saturated hydrocarbons, and glycols. Examples of solid lubricants include various higher alcohols such as stearyl alcohol, fatty acids and fatty acid esters. Suitable slipping layers have been described in e.g. EP-A 0,138,483, EP-A 0,227,090, US-A 4,567,113, US-A 4,572,860, and US-A 4,717,711.

The dye-donor element can be used in sheet form or in the form of a continuous roll or ribbon.

The support of the receiver sheet to be used in combination with the dye-donor element may be a transparant film of e.g. polyethylene terephthalate, a polyether sulfone, a polyimide, a cellulose ester, and a polyvinyl alcohol-coacetal. The support may also be a reflecting one such as e.g. baryta-coated paper, polyethylene-coated paper, and white polyester i.e. white-pigmented polyester.

To avoid poor adsorption of the transferred dye to the support of the receiver sheet, this support must be coated with a special surface, generally known as dye-image-receiving layer, into which the dye can diffuse more readily. The dye image-receiving layer may comprise e.g. a polycarbonate, a polyurethane, a polyester, a polyamide, polyvinyl chloride, polystyrene-coacrylonitrile, polycaprolactone, and mixtures thereof. Suitable dye-image-receiving layers have been described in e.g. EP-A 0,133,011, EP-A 0,133,012, EP-A 0,144,247, EP-A 0,227,094, and EP-A 0,228,066.

UV-absorbers and/or antioxidants may be incorporated into the dye-image-receiving layer for improving the fastness to light and other stabilities of the recorded images.

It is generally known to use a releasing agent that aids in separating the receiver sheet from the dye-donor element after transfer. Solid waxes, fluorine- or phosphate-containing surfactants, and silicone oils can be used as releasing agent. A suitable releasing agent has been described in e.g. EP-A 0,133,012, JP 85/19138, and EP-A 0,227,092.

When the dye transfer is performed for but one single colour, a monochrome cyan dye transfer image is obtained, which consists of at least one dye according to the present invention. A multicolour image can be obtained by using a dye-donor element containing three or more primary colour dyes, one of which consists of at least one cyan dye according to the present invention, and sequentially performing the process steps described above for each colour. The above sandwich of dye-donor element and receiver sheet is then formed on three or more occasions during the time heat is being supplied by the thermal printing head. After the first dye has been transferred, the elements are peeled apart. A second dye-donor element or another area of the dye-donor element with a different dye area is then brought in register with the receiver sheet and the process is repeated. The third colour and optionally further colours are obtained in the same manner.

In addition to thermal printing heads, laser light, infrared flash, or heated pins can be used as a heat source for supplying the heat energy. Thermal printing heads that can be used to transfer dye from the dye-donor elements of the present invention to a receiver sheet are commercially available. Suitable thermal printing heads are e.g. a Fujitsu Thermal Head (FTP-040 MCS001), a TDK Thermal Head F415 HH7-1089, and a Rohm Thermal Head KE 2008-F3.

The following example illustrates the present invention.

EXAMPLE 1

The solubility of the cyan dyes according to the present invention was compared with that of cyan dyes described in EP-A 227,096. The values of solubility are given in Table 2. It is shown that the known cyan dyes are not sufficiently soluble in such ecologically harmless solvents like ethyl methyl ketone (EMK), acetone, and ethyl acetate (EtOAc). As mentioned before, a satisfactory solubility of the dye is reached when at least 6% by weight of dye dissolves in 100 parts by weight of solution.

TABLE 2

Solubility of cyan dyes corresponding to the formula

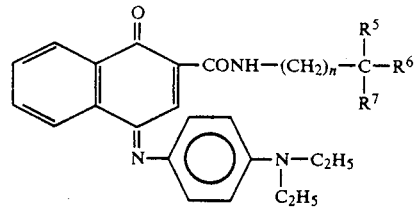

| Dye | n | $R^5$ | $R^6$ | $R^7$ | EMK | Acetone | EtOAc |
|---|---|---|---|---|---|---|---|
| Ref. 1 | 0 | H | H | H | 4.5% | 2.9% | 2.6% |
| Ref. 2 | 0 | H | $CH_3$ | $CH_3$ | 2.8% | 2.0% | 1.7% |
| Ref. 3 | 0 | $CH_3$ | $CH_3$ | $CH_3$ | 2.5% | 2.0% | 2.0% |
| Ref. 4 | 1 | $R^5$ + $R^6$ + $R^7$ complete a phenyl nucleus | | | 3.6% | 2.1% | 1.6% |
| Ref. 5 | 2 | H | H | H | 5.5% | 3.0% | 2.3% |
| Ref. 6 | 1 | H | $CH_3$ | OH | 1.5% | ~1% | ~1% |
| Ref. 7 | 1 | H | $R^6$ + $R^7$ complete cyclohexyl | | 3.3% | 1.7% | 1.7% |
| C1 | 1 | H | $CH_3$ | $CH_3$ | 20.0% | 7.3% | 6.3% |
| C2 | 2 | H | $CH_3$ | $CH_3$ | 15.0% | 10.0% | 7.0% |
| C5 | 2 | H | $CH_3$ | tert-pentyl | 35.0% | 18.5% | 23.0% |
| C6 | 1 | $CH_3$ | $CH_3$ | $CH_3$ | 13.5% | 6.1% | 4.0% |
| C7 | 2 | $R^5$ + $R^6$ + $R^7$ complete phenyl | | | 7.3% | 4.8% | 3.9% |

Ref. 1 to Ref. 7 are comparison dyes, some of which have been described in EP-A 227,096, whereas C1, C2, C5, C6, and C7 are dyes according to the present invention.

Since the known comparison dyes are insufficiently soluble in the above ecologically harmless solvents, they have to be dissolved by means of chlorinated hydrocarbons to render them printable by gravure printing techniques.

It is striking that thanks to the presence of a short alkylene group between the amide function and the branched chain alkyl group the solubility increases substantially so that such ecologically acceptable solvents like ethyl methyl ketone, acetone, and ethyl acetate can be used to make a printable dye/binder composition.

EXAMPLE 2

A dye-donor element was prepared as follows.

To avoid sticking of the dye-donor element to the thermal printing head the rear side of a 5 μm polyethylene terephthalate support was provided first with a solution for forming a slipping layer, said solution comprising 10 g of co(styrene/acrylonitrile) comprising 104 styrene units and 53 acrylonitrile units, which copolymer is sold under the trade mark LURAN 378 P by B.A.S.F., 10 g of a 1% solution of polysiloxane polyether copolymer sold under the trade mark TEGOGLIDE 410 by T. H. Goldschmidt, and sufficient ethyl methyl ketone solvent to adjust the weight of the solution to a total of 100 g. From this solution a layer having a wet thickness of 15 μm was printed by means of a gravure press. The resulting layer was dried by evaporation of the solvent.

An amount of 50 g of cyan dye as identified in Table 3 hereinafter and 50 g of binder resin were dissolved in 500 ml of ethyl methyl ketone. The binder resin was always the above-identified co(styrene/acrylonitrile), except in the case of dye C6 in which case cellulose acetate butyrate having an acetyl content of 29.5% and a butyryl content of 17% (Tg 161° C.; melting range: 230°-240° C.) was used as binder. The resulting ink-like composition was also printed by means of a gravure press on the front side of the polyethylene terephthalate support in such a way that the resulting dye/binder layer upon drying had a weight of 2.9 g per m2.

A commercially available Hitachi material (VY-S100A-paper ink set) was used as receiver sheet.

The dye-donor element was printed in combination with the receiver sheet in a Hitachi colour video printer VY-100A.

The receiver sheet was separated from the dye-donor element and the density of the recorded cyan dye image was measured by means of a Macbeth densitometer RD919 in Status A mode.

The extinction coefficient and max of the dye were determined in methanol and the stability to light of the dye was tested as follows. The receiver sheet carrying transferred dye was divided into 3 strips. The first strip was exposed for 5 h, the second for 15 h, and the third for 30 h to white light and ultraviolet radiation in a XENOTEST (trade name) type 50 apparatus of Hanau Quartzlampen GmbH, Hanau, W. Germany. The density was measured again and the loss of density in percent was derived.

These experiments were repeated for each of the dyes identified in Table 3. The comparative results obtained with the known dyes and the dyes of the present invention are listed therein.

TABLE 3

| Dye | n | $R^5$ | $R^6$ | $R^7$ | Density | Extinction coefficient | λmax (nm) | % Density loss 5 h | 15 h | 30 h |
|---|---|---|---|---|---|---|---|---|---|---|
| Ref. 1 | 0 | H | H | H | 2.09 | $2.81 \times 10^4$ | 669 | −06 | −10 | −20 |
| Ref. 2 | 0 | H | $CH_3$ | $CH_3$ | 1.90 | $2.91 \times 10^4$ | 672 | −08 | −15 | −30 |
| Ref. 3 | 0 | $CH_3$ | $CH_3$ | $CH_3$ | 1.75 | $2.97 \times 10^4$ | 674 | −04 | −10 | −25 |
| Ref. 5 | 2 | H | H | H | 2.12 | $2.88 \times 10^4$ | 671 | −09 | −14 | −26 |
| C1 | 1 | H | $CH_3$ | $CH_3$ | 2.16 | $2.99 \times 10^4$ | 674 | −08 | −12 | −20 |
| C2 | 2 | H | $CH_3$ | $CH_3$ | 2.09 | $2.78 \times 10^4$ | 673 | −04 | −11 | −23 |
| C5 | 2 | H | $CH_3$ | t-pentyl | 1.93 | $2.90 \times 10^4$ | 675 | −04 | −10 | −23 |
| C6 | 1 | $CH_3$ | $CH_3$ | $CH_3$ | 1.51 | $3.00 \times 10^4$ | 676 | −13 | −20 | −31 |
| C7 | 2 | $R^5 + R^6 + R^7$ complete $C_6H_5$ | | | 1.75 | $2.83 \times 10^4$ | 672 | −05 | −09 | −13 |

These results prove that with the dyes of the present invention high transfer densities are obtained. Moreover, the dyes of the present invention have a good hue; they have a λmax value in the desired region beyond 660 nm and they have a favourable stability to light.

We claim:

1. Dye-donor element for use according to thermal dye transfer methods, said element comprising a support having thereon a dye/binder layer comprising a 2-N-alkyl-substituted carbamoyl-4[N-(p-substituted aminoaryl)-imino]-1,4-naphthoquinone cyan dye carried by a polymeric binder resin, wherein said cyan dye is a 2-N-alkyl-substituted carbamoyl-4-[N-(p-substituted aminoaryl)-imino]-1,4-naphthoquinone cyan dye, the N-alkyl group of which is methyl that is substituted with a branched-chain non-cyclic $C_3$–$C_{18}$ alkyl group or the N-alkyl group of which is a $C_2$–$C_4$ straight chain alkyl group that on its omega-carbon atom is substituted with a branched chain $C_3$–$C_{18}$ alkyl group, an aryl group, or a cycloalkyl group.

2. A dye-donor element according to claim 1, wherein said cyan dye has the following formula:

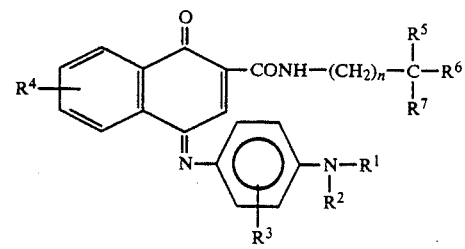

wherein:

each of $R^1$ and $R^2$ represents $C_1$–$C_8$ alkyl, cycloalkyl, or aryl, or $R^1$ and $R^2$ together represent the atoms necessary for completing a heterocyclic nucleus, or $R^1$ and/or $R^2$ together with $R^3$ represent the atoms necessary for completing a fused-on heterocyclic nucleus, $R^1$ and $R^2$ being same or different, $R^3$ is a substituent in ortho- or meta-position and is chosen from the group consisting of hydrogen, a halogen atom, $C_1$–$C_8$ alkyl, $C_1$–$C_8$ alkoxy, nitro, cyano, —NHCO—R′, —$NHSO_2$—R′, —CONH—R′ and —$SO_2NH$—R′, in which R′ stands for alkyl, cycloalkyl, or aryl, or $R^3$ together with $R^1$ and/or $R^2$ represents the atoms necessary for completing a fused-on heterocyclic nucleus, $R^4$ is a substituent standing in 5-, 6-, 7-, or 8-position and is chosen from the group consisting of hydrogen, a halogen atom, $C_1$–$C_8$ alkyl, $C_1$–$C_8$ alkoxy, nitro, cyano, —NHCO—R′, —$NHSO_2$—R′, —CONH—R′, and $SO_2NH$—R′, in which R′ stands for alkyl, cycloalkyl, or aryl, $R^3$ and $R^4$ being same or different, and n represents a positive integer from 1 to 4, with the proviso that when n = 1, $R^5$ stands for hydrogen or straight-chain or branched-chain non-cyclic $C_1$–$C_7$ alkyl, and each of $R^6$ and $R^7$ stand for straight-chain or branched-chain non-cyclic $C_1$–$C_7$ alkyl, $R^5$, $R^6$, and $R^7$ being same or different, and when n=2, 3, or 4, $R^5$ stands for a substituent selected from the group consisting of hydrogen, straight-chain or branched-chain $C_1$–$C_7$ alkyl, cycloalkyl, and aryl, and each of $R^6$ and $R^7$ stand for a substituent selected from the group consisting of straight-chain or branched-chain $C_1$–$C_7$ alkyl, cycloalkyl, and aryl, or $R^6$ and $R^7$ together represent the atoms necessary to complete an aromatic nucleus or an alicyclic nucleus, $R^5$, $R^6$, and $R^7$ being same or different.

3. A dye-donor element according to claim 1, wherein the reverse side of said dye-donor element is coated with a slipping layer comprising a lubricating material.

4. A dye-donor element according to claim 1, wherein a dye barrier layer is provided between the support and the dye/binder layer.

5. A dye-donor element according to claim 1, wherein said support comprises polyethylene terephthalate.

6. A dye-donor element according to claim 1, wherein said element has sequential repeating areas of different dyes.

* * * * *